US008474236B2

(12) United States Patent
Le Percq et al.

(10) Patent No.: US 8,474,236 B2
(45) **Date of Patent: *Jul. 2, 2013**

(54) MULTIBUNDLE METAL FIBER YARN

(75) Inventors: Lisa Le Percq, Ghent (BE); Stefaan De Bondt, Heestert (BE); Henk Troost, Gullegem (BE)

(73) Assignee: NV Bekaert SA, Zwevegem (BE)

( * ) Notice: Subject to any disclaimer, the term of this patent is extended or adjusted under 35 U.S.C. 154(b) by 82 days.

This patent is subject to a terminal disclaimer.

(21) Appl. No.: 13/130,935

(22) PCT Filed: Nov. 24, 2009

(86) PCT No.: PCT/EP2009/065759

§ 371 (c)(1),
(2), (4) Date: May 24, 2011

(87) PCT Pub. No.: WO2010/060907

PCT Pub. Date: Jun. 3, 2010

(65) Prior Publication Data

US 2011/0225946 A1 Sep. 22, 2011

(30) Foreign Application Priority Data

Nov. 25, 2008 (EP) ..... 08169881

(51) Int. Cl.
*D02G 3/02* (2006.01)

(52) U.S. Cl.
USPC ..... 57/237; 57/243

(58) Field of Classification Search
USPC ..... 57/237, 243; 219/552, 553
See application file for complete search history.

(56) References Cited

U.S. PATENT DOCUMENTS

| | | | | |
|---|---|---|---|---|
| 2,050,298 | A | 8/1936 | Everett | |
| 3,277,564 | A | 10/1966 | Webber et al. | |
| 3,379,000 | A | 4/1968 | Webber et al. | |
| 3,394,213 | A | 7/1968 | Roberts et al. | |
| 3,451,305 | A | 6/1969 | Christensen et al. | |
| 3,601,970 | A | 8/1971 | Roberts et al. | |
| 4,067,375 | A * | 1/1978 | Lejeune | 152/540 |
| 6,144,018 | A * | 11/2000 | Heizer | 219/529 |
| 6,530,205 | B1 * | 3/2003 | Gentry et al. | 57/237 |

(Continued)

FOREIGN PATENT DOCUMENTS

| | | |
|---|---|---|
| CN | 101307518 A | 11/2008 |
| EP | 1 362 941 A1 | 11/2003 |

(Continued)

OTHER PUBLICATIONS

Klaus Feyrer, Drahtseile: Bemessung, Betrieb, Sicherheit, 2000, pp. 22-23, Springer-Verlag, Berlin.

(Continued)

*Primary Examiner* — Shaun R Hurley
(74) *Attorney, Agent, or Firm* — Foley & Lardner LLP

(57) ABSTRACT

A new metal fiber yarn is provided. The metal fiber yarn (10) constitutes a construction comprising continuous metal fibers (13) forming a metal fiber yarn. The construction comprises at least 5 bundles (12) of continuous metal fibers twisted together to form a yarn. Each of the metal fiber bundles (12) comprises at least 30 metal fibers (13). The yarn comprises at least one partial yarn (11), said partial yarn comprising at least two metal fiber bundles (13) twisted around each other with a predetermined number of torsions per meter.

15 Claims, 2 Drawing Sheets

U.S. PATENT DOCUMENTS

| | | | | |
|---|---|---|---|---|
| 6,863,103 | B1 * | 3/2005 | Masubuchi et al. | 152/451 |
| 7,291,391 | B2 * | 11/2007 | Watson et al. | 428/389 |
| 2003/0006226 | A1 | 1/2003 | Yanagimoto et al. | |
| 2007/0278214 | A1 | 12/2007 | Weiss et al. | |
| 2008/0203064 | A1 * | 8/2008 | Holvoet et al. | 219/50 |
| 2011/0079589 | A1 * | 4/2011 | De Greve et al. | 219/202 |
| 2011/0114619 | A1 * | 5/2011 | Amils et al. | 219/202 |
| 2011/0225946 | A1 * | 9/2011 | Le Percq et al. | 57/243 |
| 2011/0240626 | A1 * | 10/2011 | Mullebrouck et al. | 219/260 |

FOREIGN PATENT DOCUMENTS

| | | | |
|---|---|---|---|
| EP | 1 722 017 | A1 | 11/2006 |
| JP | 51-6846 | A | 1/1976 |
| JP | 5-177243 | A | 7/1993 |
| JP | 10-18189 | A | 1/1998 |
| WO | WO 97/04152 | A1 | 2/1997 |
| WO | WO 03/095724 | A1 | 11/2003 |
| WO | WO 2005-089019 | A2 | 9/2005 |
| WO | WO 2006-120045 | A1 | 11/2006 |
| WO | WO 2007/065606 | A | 6/2007 |
| WO | WO 2007-099019 | A1 | 9/2007 |

OTHER PUBLICATIONS

U.S. Appl. No. 13/130,958, filed May 23, 2011, Rik Mullebrouck et al.

U.S. Appl. No. 13/130,919, filed May 24, 2011, Lisa Le Percq et al.

USPTO Office Action, U.S. Appl. No. 13/130,958, Dec. 19, 2012, 11 pages.

USPTO Office Action, U.S. Appl. No. 13/130,919, Jan. 31, 2013, 8 pages.

USPTO, Office Action, U.S. Appl. No. 13/130,919, Oct. 9, 2012, 9 pages.

* cited by examiner

MULTIBUNDLE METAL FIBER YARN

TECHNICAL FIELD

The present invention relates to continuous metal fibers and bundles of continuous metal fibers, e.g. obtained by the bundled drawing of wires. More specifically, the present invention relates to high quality metal fiber yarns and methods of producing these metal fiber yarns.

BACKGROUND ART

Metal fiber bundles can be obtained in various ways. Metal fibers can be obtained by a method of bundled drawing as described e.g. U.S. Pat. No. 3,379,000.Metal fibers can also be obtained e.g. by drawing till final diameter, also called end drawing. Typically, metal fibers are less than 60 μm in equivalent diameter. A metal fiber bundle is generally characterised as an array of parallel metal fibers. One type of metal fiber bundles include continuous metal fibers e.g. as obtained by bundled drawing or end drawing and combining these metal fibers into a bundle. Such metal fiber bundles can then be combined to produce metal fiber yarns. These yarns have properties such as a determined strength and electrical resistance.

To increase the strength of a metal fiber yarn with continuous metal fibers of a certain thickness, more metal fibers need to be in the yarn. This can be done in two ways: by increasing the amount of metal fibers in the bundles or by increasing the amount of metal fiber bundles in the yarn.

Increasing the amount of metal fibers per bundle in the yarn has, however, a negative effect on the flexibility of the metal fiber yarn. US2003/0006226 describes a heating wire which comprises a yarn comprising metal fibers, wherein the problem of flexibility and break of the yarn is solved by spirally winding the heat resistance wire around the outer circumference of a core wire formed of heat resistant polyamide fibers. However, this spirally winding around the outer circumference of a polyamide fiber core is prone to sleeving.

Using more metal fiber bundles in the yarn has proven to be limited, i.e. an increase in the amount of metal fiber bundles, did not result in the expected and desired increase of the strength of the metal fiber yarn.

It was further noted that an increase in the amount of metal fiber bundles in the yarn also increased the occurrence of sleeving or decomposition of the yarn resulting in bad processability of the yarn, especially when the metal fiber yarns are made through bundled drawing followed by yarn construction on composite level. When such sleeving sensitive metal fiber yarn is used during subsequent processing, congestion in guiding parts or on small passages may occur.

The smaller than expected increase in breaking force of the yarns consisting out of 5 or more continuous metal fiber bundles occurring together with an increase in the sleeving phenomenon, made people in the art conclude that using 5 or more metal fiber bundles in a yarn was not favourable.

Accordingly, this invention seeks to provide metal fiber yarns with higher breaking force without loosing flexibility and without leading to sleeving of the metal fiber yarns.

DISCLOSURE OF INVENTION

An aspect of the claimed invention provides a metal fiber yarn which comprises at least 5 bundles of continuous metal fibers twisted together to form a yarn. Each of the metal fiber bundles comprises at least 30 metal fibers. The yarn comprises at least one partial yarn. A partial yarn comprises at least two of said at least 5 metal fiber bundles twisted around each other with a predetermined number of torsions per meter. This provides a new type of continuous metal fiber yarn which is more stable, with no loss of flexibility.

In a preferred embodiment at least 2 partial yarns are twisted around each other with a predetermined number of torsions per meter.

More preferably identical partial yarns, being partial yarns comprising the same amount of metal fiber bundles, the same amount of metal fibers over a cross section, with the same amount of torsions per meter and the same torsion direction, are twisted around each other with a predetermined number of torsions per meter. This provides an even more stable metal fiber yarn.

In an alternative preferred embodiment, at least on of the at least two partial yarns has differing number of torsions per meter, and is twisted together with a same or different) predetermined number of torsions per meter to form the yarn of the invention. Such a yarn construction provides a combination of strength (of the more closed partial yarns) and an open structure (of the more open, less torded partial yarns). The open structure allowing polymer penetration of the continuous metal fiber yarn of the invention. The open structure allowing also a higher air permeability when the metal fiber yarn is produced into textiles, such as by knitting or weaving.

In one preferred embodiment the torsion direction of the partial yarns is opposite to the torsion direction of the yarn. This is what is called in the art S and Z twist. By using opposite twists in the partial and final yarn, the yarn structure will be more open allowing better polymer adhesion by the increased contact surface. In another preferred embodiment the torsion direction of the partial yarns is the same as the torsion direction of the final yarn. This embodiment results in a compact yarn with a high strength and good processability. In an even more preferred embodiment the torsions and torsion directions of the partial yarns and final yarn are the same and the amount of metal fiber bundles within the partial yarns and the amount of fibers per bundle are the same, thereby obtaining a yarn wherein the individual bundles all have substantially the same length. This results in a yarn with a high strength and large elongation.

In a further preferred embodiment the yarns of the present invention are used as partial yarns for the composition of another final yarn.

In a preferred embodiment the amount of fibers in the metal fiber bundles composing the partial yarn is the same. Even more preferably, the amount of fibers in all the bundles of the yarn of the invention is the same.

In a preferred embodiment at least part of the metal fibers are bundle drawn metal fibers.

Another aspect of the claimed invention provides a metal fiber yarn according to the invention wherein at least part of the metal fiber bundles are plastically preformed, e.g. crimped.

Still another aspect of the claimed invention provides a metal fiber yarn according to the invention wherein at least part of the metal fiber bundles in the yarn are twisted as such to have a predetermined number of torsions per meter. More preferably, all bundles in the yarn are twisted as such to have a predetermined number of torsions per meter.

In the present invention, metal is to be understood as encompassing both metals and metal alloys (such as stainless steel or carbon steel). Preferably, the metal fibers are made of stainless steel, such as e.g. AISI 316, 316L, 302, 304. In another preferred embodiment the metal fibers are made of FeCrAI-alloys, copper or nickel. In another preferred embodiment, the metal fibers are multilayer metal fibers such as described in JP 5-177243, WO 03/095724 and WO 2006/120045, e.g. metal fibers with a core of copper and an outer layer of stainless steel or metal fibers in three layers with a core of steel, an intermediate layer of copper and an outer layer of stainless steel. The metal fibers can be produced either by direct drawing or by a bundled drawing technique. In a preferred embodiment of the present invention, the metal fibers in the yarn are obtained by a bundle-drawing process. Such a process is generally known and involves the coating of a plurality of metal wires (a bundle), enclosing the bundle with a cover material to obtain what is called in the art a composite wire, drawing the composite wire to the appropriate diameter and removing the cover material of the individual wires (fibres) and the bundle, as e.g. described in U.S. Pat. No. 3,379,000, U.S. Pat. No. 3,394,213, U.S. Pat. No. 2,050,298 or U.S. Pat. No. 3,277,564. The fibers obtained with this process have a cross section which is polygonal, usually pentagonal or hexagonal in shape, and their circumference is usually serrated, as is shown in FIG. 2 of of U.S. Pat. No. 2,050,298. Compared to grouping a plurality of single-drawn fibres together to form a bundle, the bundle-drawn process allows the fibre diameter to be reduced further simultaneously. It has been observed that a reduced fibre diameter also has a positive effect on the flexlife. Therefore, in a preferred embodiment, the equivalent diameter of the metal fibers is smaller than 20 μm.

The metal fibers in the yarn have a preferred equivalent diameter in the range of 0.5 to 60 μm, more preferably in the range of 2 to 60 μm, even more preferably in the range of 6 tot 40 μm, most preferably in the range of 8 to 30 μm.

Each bundle of continuous metal fibers comprises at least 30 metal fibers and preferably less than 2500 metal fibers over a cross section. In a more preferred embodiment each bundle of continuous metal fibers comprises 1000 fibers. In an alternative preferred embodiment each bundle of continuous metal fibers comprises 275 or 90 fibers. In another alternative embodiment, the yarn comprises bundles with different amounts of metal fibers, e.g. bundles with 275 fibers combined with bundles with 90 fibers. The amount of continuous fiber bundles in the yarn is preferably equal to or less than 30, such as 5, 6, 7, 8, 9, 10, 11, 12, 13, 14, 15, 16, 17, 18, 19, 20, 21, 22, 23, 24, 25, 26, 27, 28, 29.

The metal fiber yarn can further be coated with a suitable coating, preferably Teflon, PVC, PVA, PTFE (polytetrafluoroethylene) FEP (copolymers of tetrafluoromethylene and hexafluoropropylene), MFA (perfluoroalkoxy polymer) or polyurethane lacquer. Alternatively, the metal fiber yarn can also comprise a lubricant.

Another aspect of the present invention provides a method for producing the continuous metal fiber yarn. The metal fiber yarn is composed by providing at least 5 bundles of continuous metal fibers. Each of the metal fiber bundles comprises at least 30 metal fibers. At least one partial yarn is then produced by twisting at least two of said at least 5 bundles of continuous metal fibers with a predefined number of torsions. Thereafter the at least one partial yarn is twisted together with the remaining continuous metal fiber bundles and/or partial yarns with a predetermined number of torsions to form the yarn of the invention.

Another aspect of the invention provides use of the metal fiber yarn of the invention as resistance heating elements in heatable textile applications, e.g. car seat heating.

Another aspect of the invention provides the use of the metal fiber yarn of the invention as sewing yarn.

Another aspect of the invention provides the use of the metal fiber yarn of the invention as lead wire.

Another aspect of the invention provides the use of the metal fiber yarn of the invention for the production of heat resistant textiles, such as separation material as used in the production of car glass, e.g. for the moulding of car glass to the desired shape, or such as metal burner membranes in woven or knitted form.

Another aspect of the invention provides the use of the metal fiber yarn of the invention as reinforcement elements in composite materials.

Definitions

The term "equivalent diameter" of a fiber is to be understood as the diameter of an imaginary circle having a surface area equal to the surface of the radial cross section of the fiber. In case of the bundle drawing operation, the cross section of a fiber has usually a pentagonal or hexagonal shape, and the circumference of the fiber cross section is usually serrated as is shown in FIG. 2 of U.S. Pat. No. 2,050,298; as opposed to a single drawn fiber, which has a circular cross section. In case of single drawn fibers, the equivalent diameter is to be understood as the diameter.

The term "fiber bundle" is to be understood as a grouping of individual continuous fibers.

The term "continuous fiber" is to be understood as a fiber of an indefinite or extreme length such as found naturally in silk or such as obtained by a wire drawing process. "Continuous metal fiber bundle" should in the context of this invention be understood as a bundle of continuous metal fibers, which can be obtained by bundling continuous metal fibers which were drawn till final diameter and bundled thereafter or obtained by bundled drawing wherein the bundle is obtained by leaching of the composite wire.

The term "yarn" is to be understood as a continuous strand of fibers, filaments or material in a form suitable for knitting, weaving, or otherwise intertwining to form a textile fabric. A yarn can therefore also be composed of first yarns taken together to form a new yarn.

The term "partial yarn" is to be understood as yarn comprising at least 2 fiber bundles twisted around each other.

The term "final yarn" is to be understood as a yarn comprising at least 2 partial yarns or at least 1 partial yarn and at least 1 metal fiber bundle twisted around each other.

The term "composite wire" is to be understood as the composite wire which is used in the bundled drawing process as known e.g. from U.S. Pat. No. 3,379,000, wherein the composite wire is the totality of metal fibers embedded in the matrix material enveloped in the sheath material. When the composite wire, which is drawn to desired diameter, is leached, thereby removing the matrix and sheath material, the continuous metal filaments are released and are, from then on, called continuous metal fibers. In other words, the composite wire turns into a bundle of continuous metal fibers by the leaching process.

BRIEF DESCRIPTION OF FIGURES IN THE DRAWINGS

Example embodiments of the invention are described hereinafter with reference to the accompanying drawings in which FIG. 1 shows a transverse cross-section of a first embodiment of the invented yarn.

Figure 4:
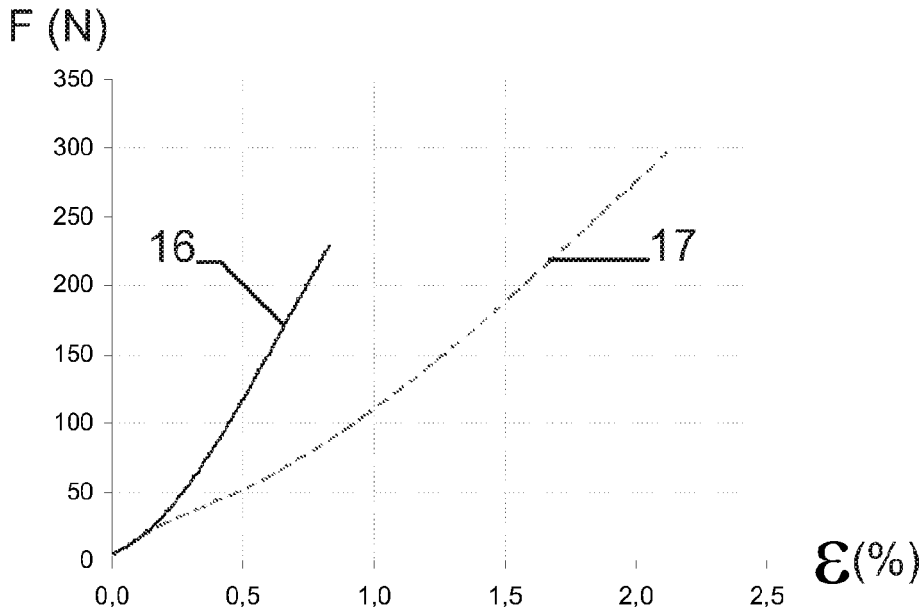

FIG. 4 compares the load-elongation curve of a known yarn with the load-elongation curve of the yarn according to the invention.

Figure 5:
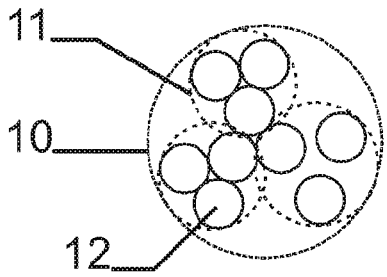

FIG. 5 shows a transverse cross section of an alternative preferred embodiment of the present invention.

MODE(S) FOR CARRYING OUT THE INVENTION

Examples of metal fiber yarns and different methods for obtaining the metal fiber yarn of the invention will now be described with reference to the Figures.

Figure 1:
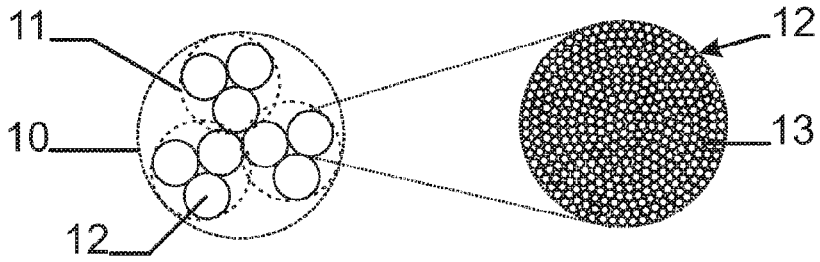

FIG. 1 shows the transverse cross section of a 3×3 yarn. The final yarn 10 comprises 3 partial yarns 11 twisted around each other. The partial yarns 11 comprise 3 continuous metal fiber bundles 12 twisted around each other. Each fiber bundle comprises 90 continuous metal fibers 13. This yarn is produced in two steps.

Figure 2:
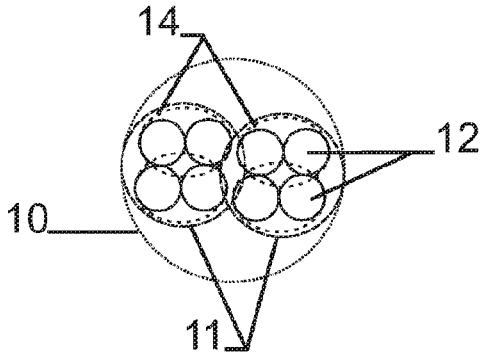
FIG. 2 shows a transverse cross-section of a second embodiment according to the invention.

FIG. 2 shows the transverse cross section of a 2×2×2 yarn. The final yarn 10 consists out of 2 partial yarns 11 twisted around each other. Each partial yarn 11 comprises 2 first partial yarns 14 twisted around each other. Each first partial yarn 14 comprises 2 continuous metal fiber bundles 12 twisted around each other and each fiber bundle comprises 275 continuous metal fibers 13. This yarn is produced in 3 steps.

Figure 3:
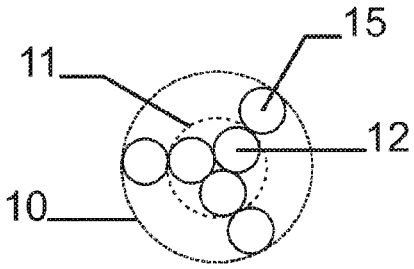
FIG. 3 shows a transverse cross-section of a third embodiment according to the invention.

FIG. 3 shows the transverse cross section of a (3×1)+3 yarn. The final yarn 10 comprises a partial yarn 11 and three single metal fiber bundles 15 twisted around each other. The partial yarn 11 comprises 3 metal fiber bundles 12 twisted around each other wherein each fiber bundle comprises 275 continuous metal fibers 13. This yarn is produced in 2 steps.

FIG. 4 shows two load-elongation curves 16 and 17. The abscissa is the elongation 8, expressed in percent, and the ordinate is the load F, expressed in Newtons (N).

Curve 16 is the load-elongation curve of a prior art yarn comprising 8 metal fiber bundles. Each of the fiber bundles comprises 275 continuous AISI 316L metal fibers with an equivalent diameter of 12 micron. The bundles are twisted around each other in one step and with 100 torsions per meter in the S-direction.

Curve 17 is the load-elongation curve of a 2×2×2 yarn according to the invention and as shown in FIG. 2, comprising 8 continuous metal fiber bundles. Each of the fiber bundles comprises 275 continuous AISI 316L metal fibers with an equivalent diameter of 12 micron. The yarn is composed in 3 steps. A first partial yarn is composed by twisting two bundles of continuous metal fibers around each other with 100 torsions per meter in the S-direction. In a second step a second partial yarns is composed by twisting two of the first partial yarns around each other with 100 torsions per meter in the S-direction. In a third step the final yarn is composed by twisting two of the second partial yarns around each other with 100 torsions per meter in the S-direction.

In FIG. 4 it is shown that the breaking force of the invention 2×2×2 yarn (curve 17) is 295 N while the breaking force of the prior art yarn (curve 16) is 240N. Both yarns comprise the same amount of fiber bundles with the same amount of metal fibers per bundle and have the same amount of torsions per meter. FIG. 4 illustrates that the breaking force of a yarn can be increased significantly by the use of a yarn construction according to the invention. In this case the breaking force of the yarn is increased with more then 20% and also a higher elongation is obtained.

FIG. 5 shows an alternative preferred embodiment of the present invention. FIG. 5 shows the transverse cross section of a 3×3 yarn. The final yarn 10 comprises 3 partial yarns 11 twisted around each other. The partial yarns 11 comprise 3 continuous metal fiber bundles 12 twisted around each other. Each fiber bundle comprises 275 continuous metal fibers 13. One of the three partial yarns has a torsion of 50 torsions per meter in Z direction, whereas the other two partial yarns have a torsion of 120 torsions per meter in S direction. The partial yarns are then twisted around each other with 100 torsions per meter in S direction.

Aspects of the invention are set out in the following series of numbered claims.

The invention claimed is:

1. A metal fiber yarn comprising at least five bundles of continuous metal fibers, said at least five bundles being twisted together, each of said metal fiber bundles comprising at least thirty continuous metal fibers, wherein said yarn comprises at least one partial yarn, wherein said at least one partial yarn comprises at least two of said continuous metal fiber bundles twisted around each other with a predetermined number of torsions per meter, wherein said yarn comprises at least two partial yarns twisted around each other with a predetermined number of torsions per meter.

2. A metal fiber yarn according to claim 1, wherein all of said partial yarns have the same amount of continuous metal fibers per bundle, the same equivalent diameter of continuous metal fibers per bundle, the same amount of bundles per partial yarn and the same torsion direction, wherein all of said partial yarns are thereby identical.

3. A metal fiber yarn according to claim 1, wherein at least part of said metal fibers are bundle drawn metal fibers.

4. A metal fiber yarn according to claim 1, wherein at least part of said metal fibers are made of stainless steel.

5. A metal fiber yarn according to claim 1, wherein at least part of the metal fibers in said metal fiber bundles have a cross section comprising at least one concentric metal layer over a metal core.

6. A metal fiber yarn according to claim 5, wherein the core of said fibers is copper and an outer layer is stainless steel.

7. A metal fiber yam according to claim 5, wherein the core of said fibers is stainless steel and an outer layer is copper.

8. A metal fiber according to claim 1, wherein said metal fiber yarn further comprises a coating.

9. A method of producing a continuous metal fiber yarn said method comprising:

providing at least five bundles of continuous metal fibers, each of said at least five bundles of continuous metal fibers comprising at least thirty metal fibers;

twisting at least two of said at least five bundles of continuous metal fibers together with a predetermined number of torsions per meter to form at least one partial yarn; and twisting said at least one partial yarn together with the remaining continuous metal fiber bundles and/or partial yarns with a predetermined number of torsions per meter, wherein said yarn comprises at least two partial yarns twisted around each other with a predetermined number of torsions per meter.

10. A method of producing a continuous metal fiber yarn said method comprising:

providing at least five composite wires, each of said composite wires comprising at least thirty metal fibers;

twisting at least two of said at least five composite wires together with a predetermined number of torsions per meter to form at least one partial yarn;

twisting said at least one partial yarn together with the remaining composite wires and/or partial yarns with a predetermined number of torsions per meter, thereby obtaining a composite wire construction; and leaching said composite wire construction in appropriate acid, thereby obtaining the metal fiber yarn.

11. A resistance heating element in a heatable textile application, the resistance heating element comprising the metal fiber yarn of claim 1.

12. A resistance heating element as in claim 11, wherein said heatable textile application is car seat heating.

13. A sewing yarn comprising the metal fiber yarn as in claim 1.

14. A composite material comprising a reinforcement element, the reinforcement element being the metal fiber yarn as in claim 1.

15. A metal fiber yarn according to claim 8, wherein the coating is selected from the group consisting of Teflon, PVC, PVA, PTFE, FEP, MFA and polyurethane lacquer.

* * * * *